US005460267A

United States Patent [19]

Schiffer

[11] Patent Number: 5,460,267

[45] Date of Patent: Oct. 24, 1995

[54] RECEPTACLE FOR STORAGE AND DISPLAY OF NOTIONS

[75] Inventor: Helmut Schiffer, Stolberg, Germany

[73] Assignee: William Prym-Werke GmbH. & Co. KG., Stolberg, Germany

[21] Appl. No.: 198,546

[22] Filed: Feb. 18, 1994

Related U.S. Application Data

[63] Continuation of Ser. No. 949,427, Sep. 22, 1992, abandoned.

[30] Foreign Application Priority Data

Dec. 13, 1991 [DE] Germany ..... 9115479 U

[51] Int. Cl.[6] ..... B65D 85/24

[52] U.S. Cl. ..... 206/380; 206/470; 206/471

[58] Field of Search ..... 206/380, 381, 206/387, 470, 471, 268, 806

[56] References Cited

U.S. PATENT DOCUMENTS

| | | | |
|---|---|---|---|
| 348,924 | 9/1886 | Munson | 206/268 X |
| 469,138 | 2/1892 | Harper | 206/380 X |
| 1,822,512 | 9/1931 | Tanner | 206/268 X |
| 1,956,642 | 5/1934 | Einson | 206/806 X |
| 2,090,723 | 8/1937 | Callmander | 206/268 X |
| 2,545,611 | 3/1951 | Flannery | 206/380 |
| 2,713,937 | 7/1955 | Schneider | 206/380 |
| 3,647,057 | 3/1972 | Ashmead et al. | 206/380 X |
| 3,899,125 | 8/1975 | Andrews et al. | 206/268 X |
| 4,236,636 | 12/1980 | Kuchenbecker | 206/470 X |
| 4,243,141 | 1/1981 | Takahashi | 206/380 |
| 4,386,697 | 6/1983 | Zocher | 206/383 |
| 4,637,512 | 1/1987 | Smith | 206/380 X |
| 4,708,241 | 11/1987 | Black | 206/380 X |
| 4,938,462 | 7/1990 | Gould | 206/470 |
| 5,067,611 | 11/1991 | Hagmann et al. | 206/383 |

FOREIGN PATENT DOCUMENTS

| | | | |
|---|---|---|---|
| 2334190 | 1/1975 | Germany | 206/268 |
| 1786561 | 1/1975 | Germany | 206/380 |
| 0001919 | of 1898 | United Kingdom | 206/380 |

*Primary Examiner*—Paul T. Sewell
*Assistant Examiner*—Kavanaugh: Ted
*Attorney, Agent, or Firm*—Darby & Darby

[57] ABSTRACT

A receptacle for storage and display of needles has a flat rear panel of cardboard and a flat front panel of light-transmitting plastic material. Each panel has a first section and a second section, and the first sections are bonded to each other except to define a first chamber with parallel pockets for first portions of needles. The second sections are separably bonded to each other and define a second chamber for second portions of needles. The second section of the rear panel has a first leaf which can be pivoted away from the second section of the front panel, and a second leaf which can be pivoted relative to the first leaf and carries a tongue at the junction of the two leaves. The second section of the front panel has a first flap which can be pivoted away from the rear panel and away from the second portions of the needles so that such second portions become accessible upon pivoting of the first flap and the first leaf away from each other and away from the needles. A second flap of the second section of the front panel can be folded over the second portions of the needles and can be retained in such position by the tongue of the second leaf upon pivoting of the first flap back to its original position adjacent the second portions of the needles.

23 Claims, 3 Drawing Sheets

FIG. 5
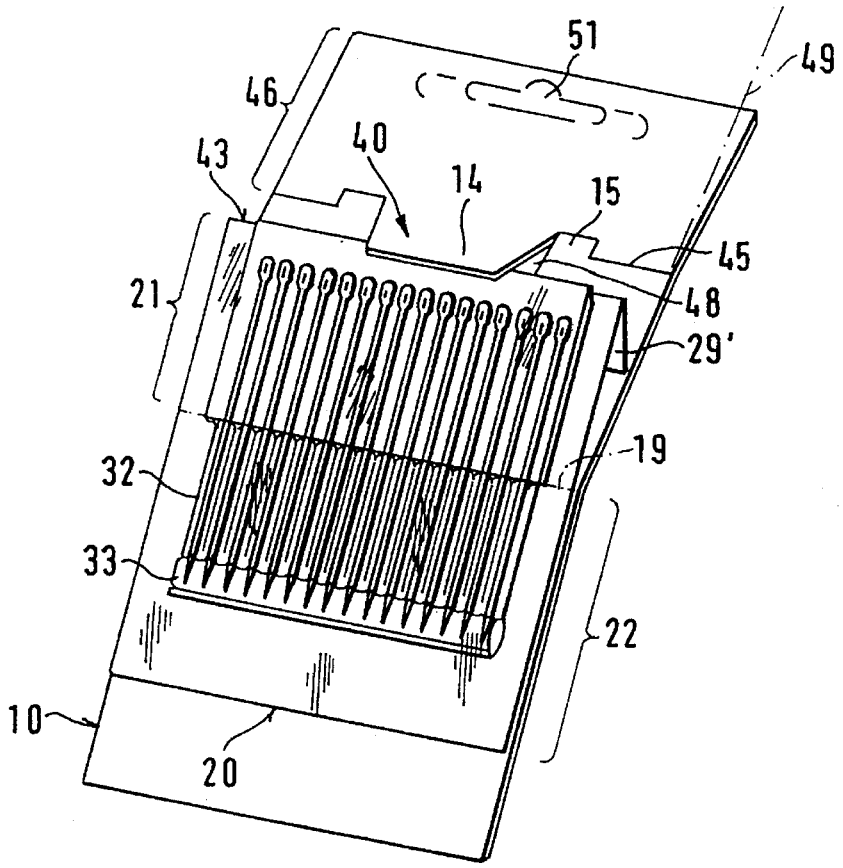
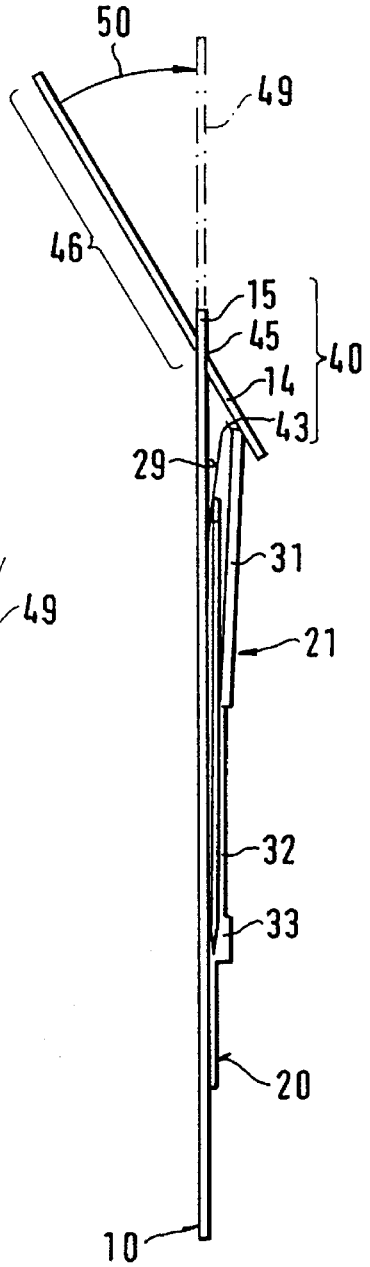
FIG. 6

RECEPTACLE FOR STORAGE AND DISPLAY OF NOTIONS

This is a continuation of application Ser. No. 07/949,427, filed Sep. 22, 1992, now abandoned.

BACKGROUND OF THE INVENTION

The invention relates to improvements in receptacles for storage or display of notions, such as needles, pins and the like. More particularly, the invention relates to improvements in receptacles (also called blister packs) of the type disclosed in commonly owned U.S. Pat. No. 5,067,611 granted Nov. 26, 1991 to Hagmann et al.

The patent to Hagmann et al. discloses a receptacle wherein a rear panel or carrier has two sections which are connected to each other by a hinge and wherein one section of a light-transmitting front panel or cover is permanently connected to the front side of one section of the rear panel. The other sections of the two panels are separably connected to each other and can be pivoted away from one another in order to expose first portions of needles the second portions of which extend into discrete pockets between the permanently connected sections. The other sections can be pivoted back against each other to confine the first portions of the needles, i.e., those portions which project beyond the respective pockets, and the other section of the rear panel has a flap which can releasably retain the other section of the front panel in a position of substantial alignment with the one section of the front panel.

It is important and desirable to ensure that the needles which remain in their pockets be reliably confined between the other sections of the two panels when the flap overlies the other section of the front panel. Even a relatively narrow clearance between the other sections of the two panels will suffice to permit the escape of one or more slender needles or like commodities, even if the flap overlies the other section of the front panel. This can result in the loss of a substantial number of needles and creates the possibility of injury to children or adults, e.g., by stepping onto a needle which happened to escape between the other sections of the two panels. Thus, there exists an urgent need for receptacles which can be used for storage and display of needles or like notions and are constructed and assembled in such a way that a needle which extends into a pocket between the permanently connected sections of the two panels is not likely to escape, even if the receptacle is dropped or is subjected to other rough treatment.

OBJECTS OF THE INVENTION

An object of the invention is to provide a receptacle for orderly storage and display of needles or like notions in such a way that the notions which extend into their pockets can be reliably prevented from leaving the pockets even after the seal or another initial connection between the pivotable sections of their panels is destroyed or disengaged.

Another object of the invention is to provide novel and improved panels for use in the above outlined receptacle.

A further object of the invention is to provide a simple and inexpensive receptacle which can be used for the storage and display of any desired practical number of needles or like notions.

An additional object of the invention is to provide a receptacle which can be readily manipulated by semiskilled or unskilled persons without any instructions or upon perusal of minimal instructions.

Still another object of the invention is to provide a novel and improved method of securing needles or like notions in their pockets upon initial or renewed exposure of portions of needles for withdrawal from the receptacle.

A further object of the invention is to provide a novel and improved method of reclosing a receptacle for needles and like commodities.

Another object of the invention is to provide a receptacle which constitutes an improvement over and a further development of the receptacle described and shown in the commonly owned U.S. Pat. No. 5,067,611.

An additional object of the invention is to provide a compact receptacle which is designed to be displayed in self-service sections of cigar stores, department stores, hardware stores and/or other establishments where a customer is expected or permitted to select commodities and to carry or transport them to a salesperson.

Still another object of the invention is to provide the receptacle with novel and improved means for securing the pivotable sections of the panels in confining positions.

SUMMARY OF THE INVENTION

The invention is embodied in a receptacle for storage and display of discrete needles and like notions. The improved receptacle comprises a first flat panel having a front side and a rear side and preferably consisting of cardboard or the like, and a substantially flat second panel which is disposed at the front side of the first panel and preferably consists of a light-transmitting (transparent or translucent) synthetic plastic material. The panels have first sections which define a first chamber for first portions of discrete notions, and second sections defining a second chamber for second portions of discrete notions adjacent the first chamber. The first sections are substantially permanently affixed (e.g., bonded) to each other around the first chamber, and the receptacle further comprises means for separably affixing the second sections to each other at the second chamber. The second section of the second panel is pivotable relative to the second section of the first panel between a first position adjacent the front side of the first panel and a second position away from the second portions of notions, and the second section of the second panel comprises a first flap which overlies the second portions of the notions in the first position of the second section of the second panel and a second flap, or border strip, which is pivotable relative to the first flap to a folded position between the second portions of the notions and the front side of the first panel in the first position of the second section of the second panel.

The first section of the second panel is preferably provided with first recesses forming part of the first chamber, and the second section of the second panel is preferably provided with a second recess forming part of the second chamber. The second panel can be provided with a first weakened portion which constitutes a first hinge and is disposed between the first and second sections of the second panel, and with a second weakened portion which constitutes a second hinge and is disposed between the first and second flaps.

The second section of the first panel is preferably provided with means for releasably holding the second flap,or border strip, in the folded position. Such holding means can comprise a tongue forming part of the second section of the first panel.

The first panel can include a first weakened portion between its first and second sections, and the second section of the first panel is pivotable along the first weakened portion away from the second portions of the notions and away from the second section of the second panel. The first hinge of the second panel is preferably adjacent the first weakened portion of the first panel. A second weakened portion of the first panel is adjacent the second hinge of the second panel and divides the second section of the first panel into a first leaf between the first and second weakened portions and a second leaf which is connected to the first leaf by the second weakened portion. The first leaf is pivotable relative to the first section of the first panel along the first weakened portion of the first panel in a direction away from the second portions of the notions, and the second leaf is pivotable relative to the first leaf along the second weakened portion of the first panel. The means for releasably holding the second flap, or border strip, of the second section of the second panel in the folded position can be provided on (e.g., it can form part of) and can be pivoted with the second leaf of the second section of the first panel. As mentioned above, the holding means can comprise a tongue, and such tongue can be an integral extension of the second leaf and can be disposed between two spaced-apart parts of the second weakened portion of the first panel. The first leaf of the second section of the first panel can comprise two lugs which are pivotable with the first leaf relative to the second leaf and flank the tongue of the second leaf.

The second section of the first panel (preferably the second flap of such second section) can be provided with at least one opening which facilitates suspension of the first panel on a rod-like support of the type customarily employed in self-service outlets including hardware stores, department stores, cigar stores and analogous establishments where the customers are expected or permitted to remove selected items from their supports and to carry or transport them (e.g., in shopping carts) to a checkout counter. The holding means is preferably disposed between the opening or openings in the second section of the first panel and the second chamber. The aforementioned affixing means can include one, two or more readily destructible bonds (e.g., patches of hardened adhesive) between the second sections of the two panels. Such affixing means is preferably provided between the second section of the first panel and the second flap of the second section of the second panel.

The first chamber between the first sections of the two panels can comprise a plurality of at least partially separated pockets (e.g., in the form of elongated quivers) for the first portions of the notions. The pockets can be parallel to each other in order to maintain the inserted notions in parallelism with each other.

The two sections of the second panel preferably comprise profiled first portions which are adjacent the first and second chambers, and flat frame-like second portions which surround the profiled first portions. The first hinge of the second panel is disposed between the two sections of the second panel as well as between the profiled and flat frame-like portions of the second panel.

The second hinge of the second panel can be constituted by a fold line between the first and second flaps of the second section of the second panel.

The novel features which are considered as characteristic of the invention are set forth in particular in the appended claims. The improved receptacle itself, however, both as to its construction and the mode of using the same, together with additional features and advantages thereof, will be best understood upon perusal of the following detailed description of certain presently preferred specific embodiments with reference to the accompanying drawings.

BRIEF DESCRIPTION OF THE DRAWINGS

FIG. 5 is a further perspective view showing the flaps in the positions of FIG. 4 but with the leaves of the second section of the first panel pivoted back close to the positions of FIGS. 1 and 2, the tongue of the second leaf being shown in the operative position in which it releasably holds the second flap in the folded position; and FIG. 6 is a side elevational view as seen from the left-hand side of FIG. 5, the final position of the second leaf, in which the second flap is more or less positively held in the folded position, being indicated by phantom lines.

DESCRIPTION OF PREFERRED EMBODIMENTS

Figure 1:
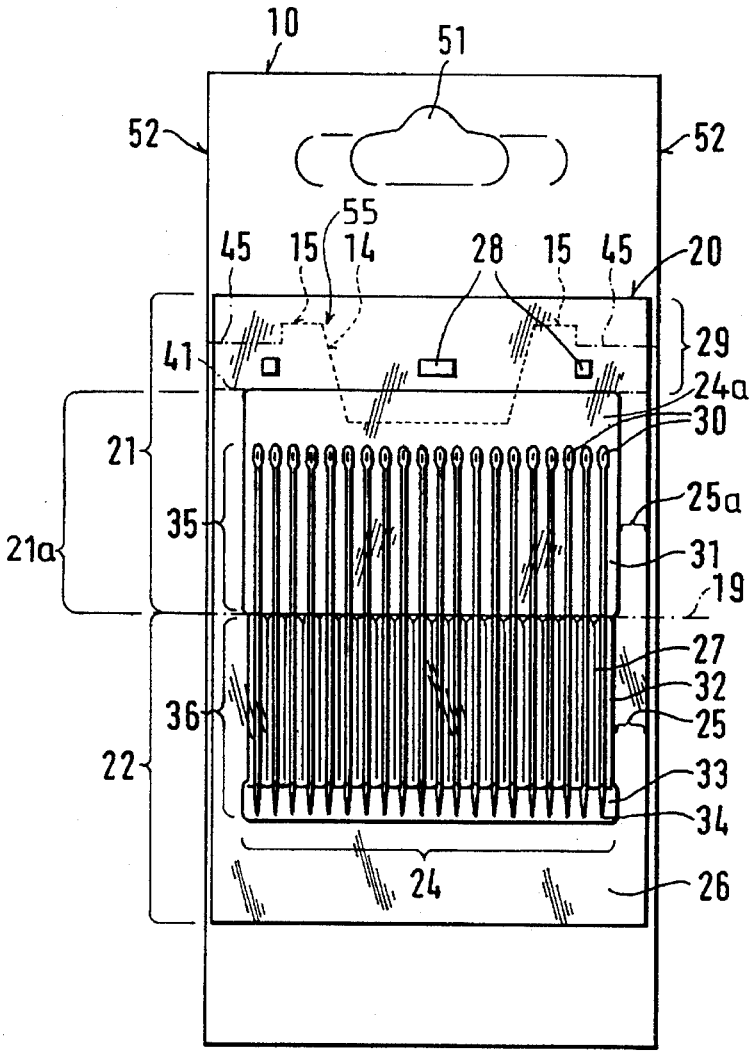
FIG. 1 is an enlarged front elevational view of a receptacle which embodies one form of the present invention, the flaps of the second section of the second panel and the leaves of the second section of the first panel being shown in unfolded positions.
Figure 2:
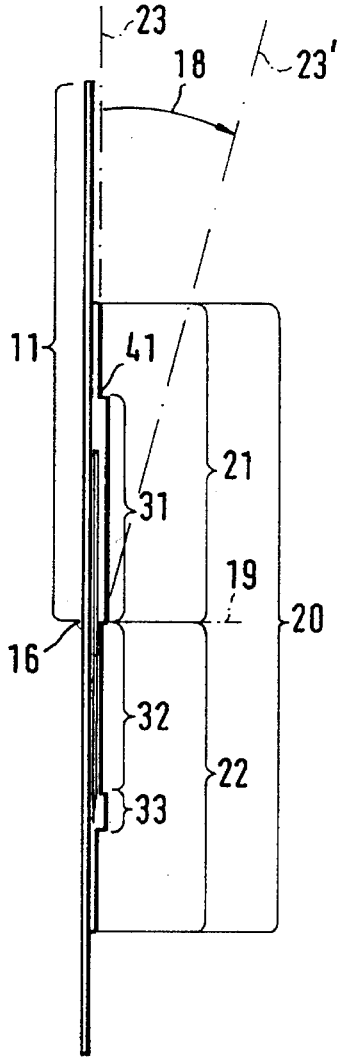
FIG. 2 is a side elevational view of the receptacle as seen from the left-hand side of FIG. 1.

The improved receptacle comprises a normally flat first or rear panel 10 which can be made of cardboard or the like, and a normally flat second or front panel 20 which can be made of light-transmitting (transparent or translucent) synthetic plastic material. The second panel 20 is adjacent the front side of the first panel 10 and the rear side of the panel 10 can be provided with instructions how to manipulate the receptacle, with data pertaining to the sizes of notions (needles 30) which are stored in the chambers 32 and 31 between the panels 10, 20 and/or with other information. FIGS. 1 and 2 show the receptacle in fully assembled condition ready for display in a self-service store or another establishment so that it can be removed from a suitable support by an interested customer and carried or transported in a shopping cart to a checkout counter. When the receptacle is fully assembled, the two panels are disposed in two paralleplanes. The depth of the two chambers 32, 31 (as measured at right angles to the front side of the panel 10) need not exceed the diameters of the needles 30.

The first chamber 32 is disposed between a first section 13 of the first panel 10 and a first section 22 of the second panel 20. This chamber includes a plurality of (e.g., twenty) parallel pockets 27 which are separated from each other by narrow ribs of the section 22. Such ribs can but need not adhere to the front side of the first section 13 of the panel 10, as long as they are sufficiently long and sufficiently close to the front side of the panel 10 to ensure that the pockets 27 are adequately separated from each other so as to maintain the corresponding first portions 36 of the properly inserted needles 30 in at least substantial parallelism with each other as shown in FIG. 1. The first chamber 32 further includes a relatively narrow uninterrupted portion 33 which receives the pointed tips 34 of the needles 30. The chamber 32 is formed primarily by a suitably profiled recess in the rear side of the first section 22 of the panel 20.

The second chamber 31 is formed primarily by a relatively large single recess or depression in the rear side of the profiled second section 21 of the panel 20; such second section is adjacent a second section 11 of the panel 10.

A fold line or an otherwise weakened straight elongated portion 19 of the panel 20 constitutes a rudimentary hinge between the sections 21, 22 of the panel 20 and enables a user to pivot the second section 21 from the normal or starting position shown in FIGS. 1 and 2 to a second position (shown in FIG. 3 by solid lines) in which the section 21 is spaced apart from those portions (35) of the needles 30 which are normally confined in the second pocket 31. The first section 22 of the second panel 20 is more or less permanently affixed to the front side of the first section 13 of the first panel 10 by an adhesive (as indicated at 26). More specifically, the adhesive 26 constitutes a more or less permanent bond between the front side of the section 13 and the rear side of a substantially U-shaped flat frame-like portion 25 forming part of the section 22 and surrounding three sides of the first chamber 32. The second section 21 of the panel 20 comprises a first rectangular flap **21*a* which is adjacent the hinge 19 and a second rectangular flap, or border strip, 29 which is pivotally connected with the first flap 21*a* by a second rudimentary hinge 41, e.g., a fold line or another straight elongated weakened portion of the panel 20. The hinge 19 is parallel to the hinge 41. The section 21 of the panel 20 can be said to include a profiled portion 24*a* adjacent the second chamber 31, and a flat frame-like portion 25*a* which surrounds the profiled portion 24*a* at three sides and is separably affixed to the front side of the second section 11 of the panel 10. Three readily destructible adhesive bonds 28 are shown between the rear side of the flap 29 and the adjacent portion of the front side of the second section 21 of the panel 10. The flat frame-like portions 25, 25*a* together form a relatively narrow rectangular frame which completely surrounds the chambers 31 and 32, which more or less permanently adheres (at 25, 26) to the front side of the first section 13 of the panel 10, and which is readily separably bonded (at 24*a*, 28) to the second section 11 of the panel 10**.

Upon destruction of the adhesive bonds 28, the user can pivot the entire second section 21 of the second panel 20 from the normal position (indicated in FIG. 2 by a phantom line 23) toward and beyond a second position (note the arrow 18 in FIG. 2) and through an intermediate position which is indicated in FIG. 2 by a second phantom line 23'. A presently preferred second position of the section 21 (in a plane 23") is shown in FIG. 3; the flap **21*a* is then remote from the portions 35 of needles 30 in the exposed chamber 32 and does not interfere with withdrawal of selected needles from their pockets 27 and/or with insertion or reinsertion of certain needles into predetermined or randomly selected pockets 27**.

The recesses in the rear side of the panel 20 can be made during forming of such panel in a suitable machine, or they may be impressed into light-transmitting rectangular plastic blanks in response to the application of requisite heat and/or pressure in order to ensure the formation of satisfactory chambers 31, 32 when the frame-like portion 25 and the flap 29 of the thus obtained panel 20 are bonded (at 26 and 28, respectively) to the front sides of the respective sections 13, 11 of the panel 10.

The rigidity of the panel 20 can be selected in such a way that its section 21 normally assumes the position which is shown in FIGS. 1 and 2 even if the flap 29 is not bonded (at 28) to the second section 11 of the panel 10. However, the patches of adhesive which constitute the three illustrated readily breakable bonds 28 are preferred in many instances because they enable the potential purchaser to ascertain whether or not the receptacle has been tampered with, i.e., whether or not the section 21 of the panel 20 was already pivoted along the hinge 19 toward or all the way to the position of FIG. 3. The number and distribution of bonds 28 are preferably selected in such a way that they prevent accidental escape of one or more needles 30 from the chambers 31, 32 during rough handling of the fully assembled receptacle. In other words, access to the needles 30 should be gained only in response to breaking of one or more bonds 28. 0f course, it is equally within the purview of the invention to bond a relatively large portion of or the entire flap 29 to the adjacent front side of the second section 11 of the panel 10, as long as the section 21 can be readily separated from the section 11 so that it can be pivoted to the solid-line position of FIG. 3 or at least close to such position.

Figure 3:
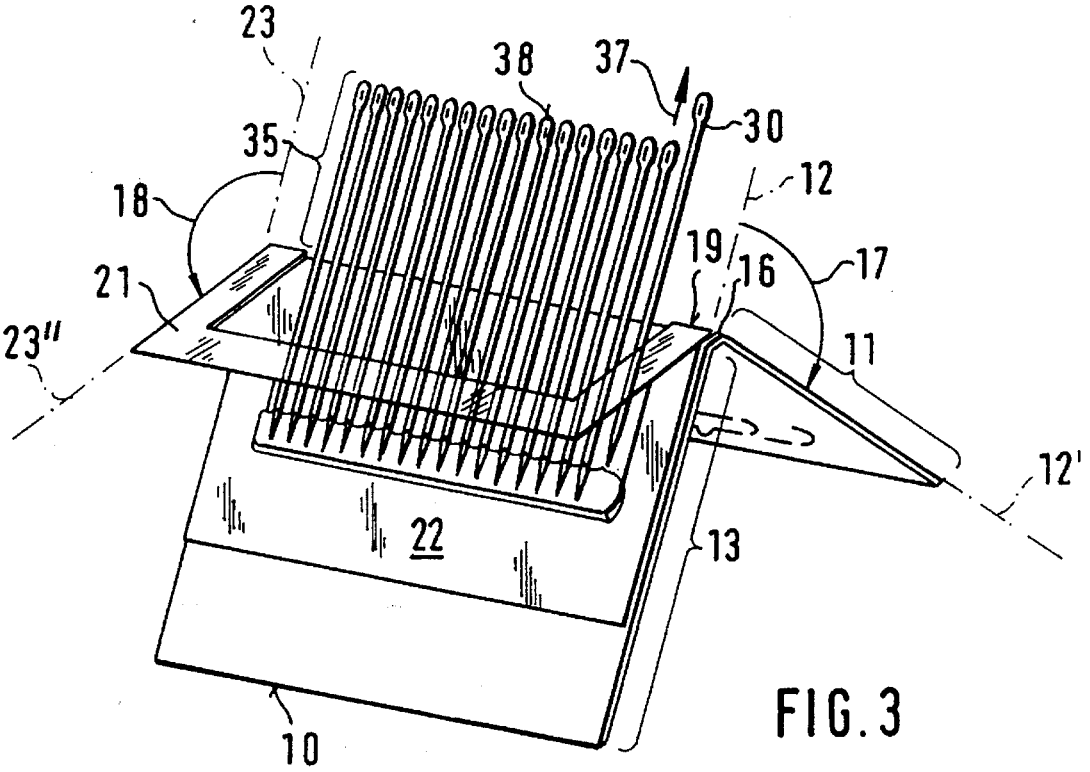
FIG. 3 is a smaller-scale perspective view of the receptacle, the second sections of the two panels being pivoted away from the adjacent portions of the notions so that the notions are readily accessible for withdrawal from the pockets between the first sections of the panels.

As can be seen in FIGS. 2 and 3, the panel 10 is provided with a first elongated weakened portion 16 (e.g., a fold line) which is disposed between the sections 11, 13 and enables the section 11 to pivot away from the section 21 of the panel 20 toward and even beyond the position of FIG. 3. This moves the section 11 away from the portions 35 of the needles 30 so that, if the section 21 is pivoted to the solid-line position of FIG. 3, the portions 35 of the needles 30 are accessible from each of the two sides of the row of needles whose portions 36 extend into the respective pockets 27 and whose tips 34 are received in the narrow portion 33 of the chamber 32. The weakened portion 16 of the panel 10 is adjacent to and is parallel with the hinge 19 between the sections 21 and 22 of the panel 20. The phantom line 12 indicates the plane of the section 11 prior to pivoting from the position of FIGS. 1 and 2, and the phantom line 12' indicates the plane of the section 11 subsequent to pivoting away from the portions 35 of the needles 30. The arrow 17 indicates the direction of pivoting of the section 11 from the plane 12 into the plane 12'. When the sections 11 and 21 assume the positions of FIG. 3, any one of the twenty needles 30 is readily accessible and can be grasped by two fingers to be extracted from its pocket 27 in the direction of arrow 37. The user will grasp the eyelets 38 at the exposed ends of the selected needles 30. Reinsertion of a needle 30 into a predetermined pocket 27 or into any of the unoccupied pockets is an equally simple procedure.

Figure 4:
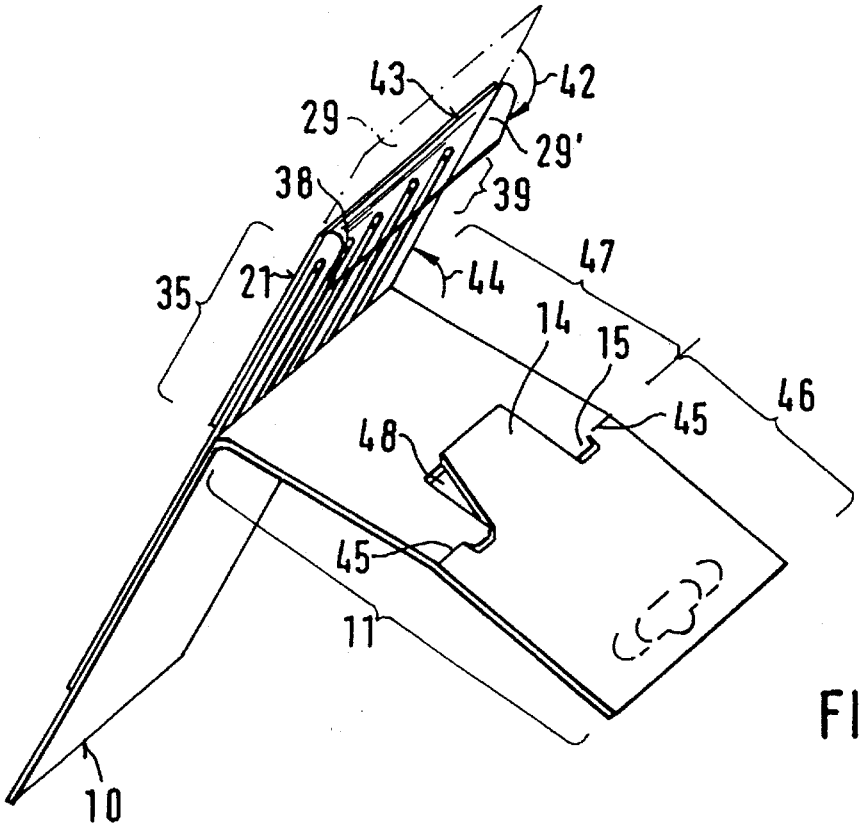
FIG. 4 is another perspective view showing the second section of the first panel substantially in the position of FIG. 3 but with the first flap of the second section of the second panel pivoted back to the position of FIGS. 1 and 2 and with the second flap of the second section of the second panel folded behind the adjacent end portions of the notions.

In accordance with an advantageous feature of the invention, the improved receptacle is designed in such a way that the sections 11, 21 of the panels 10, 20 can be returned to the positions of FIGS. 1 and 2 and can be caused to remain in such positions. At the same time, the thus returned sections 11 and 21 cooperate to reliably prevent the escape of any needles 30 from their pockets 27 even though the bonds 28 between the flap, or border strip, 29 and the adjacent portions of the section 11 of the panel 10 are already destroyed. This is achieved by pivoting the section 21 from the solid-line position of FIG. 3 back to the solid-line position of FIGS. 1 and 2, and by thereupon folding or pivoting the flap 29 (arrow 42 in FIG. 4) along the hinge 41, i.e., relative to the flap **21*a*, so that the flap 21*a* is located in front of and the flap, or border strip, 29 is located behind the portions 35 of the needles 30 (see FIGS. 4 and 5). Such pivoting the flap, or border strip, 29 relative to the flap 21***a* takes place prior to pivoting (or prior to completed pivoting) of the section 11 in the direction of arrow 44 (FIG. 4) back to the position of FIGS. 1 and 2. As can be seen in FIG. 4, the hinge 41 then constitutes the apex 43 of a roof-line structure 40 (FIG. 5) including the flaps 21*a*, 29 and confining certain parts (39) of needle portions 35 in the chamber 31.

Each of the weakened portions or hinges 16, 19 and 41 can include a row of perforations or can be constituted by a suitable fold line in the respective panel. The same applies for a fourth weakened portion or hinge 45 which is provided between two flaps or leaves 47, 46 (hereinafter called leaves to distinguish from the flaps 21*a* and 29) of the second section 21 of the panel 10. The weakened portion 45 is parallel to and can be adjacent (but not necessarily immediately adjacent) the hinge 41 between the flaps 21*a* and 29.

If the second sections 11 and 21 were merely pivoted back to the positions of FIGS. 1 and 2, they could but would not necessarily remain in such positions in which the roof-like structure 40 would prevent the needles 30 from leaving their pockets 27 and the sections 11, 21 would remain closely adjacent to each other so that the receptacle would constitute a rather flat body resembling that which is shown in FIG. 2. In order to ensure that the flap, or border strip, 29 will remain in the folded position 29' of FIGS. 4 and 5 (beyond the portions 35 of the needles 30), the leaf 46 of the section 11 comprises a holding means in the form of a tongue 14 disposed substantially midway between the longitudinally extending parallel marginal portions 52 of the panel 10, i.e., between two spaced-apart parallel parts of the second weakened portion 45 of the panel 10. The leaf 46 can be pivoted relative to the leaf 47 before the leaf 47 is pivoted back to the position of FIGS. 1 and 2 whereby the tongue 14 can be caused to ride over the ridge 43 and to overlie the front side of the flap 21*a* before the leaf 46 is returned into the plane of the leaf 47 to thus retain the flap 29 in the folded-over position 29' behind the eyelets 38 of the needles 30. Such pivoting of the leaf 46 takes place in the direction of arrow 50 (FIG. 6) and is completed when the leaf 46 assumes the phantom-line position 49.

If a user thereupon desires to withdraw one or more needles 30, the leaf 46 is pivoted from the position 49 of FIG. 6 to and beyond the solid-line position of FIG. 5 (counter to the direction which is indicated by the arrow 50) so that the tongue 14 is disengaged from the roof-like structure 40 and the flap, or border strip, 29 can be pivoted from the folded position 29' of FIG. 4 to the position which is indicated by phantom lines. The next step involves pivoting of the sections 11 and 21 away from each other, e.g., all the way to the solid-line positions of FIG. 3, so that each of the needles 30 is readily accessible and can be withdrawn in the direction of arrow so that it leaves its respective pocket 27.

FIGS. 1, 5 and 6 show that the leaf 47 of the second section 11 of the panel 10 is formed with two relatively small lugs 15 which flank the tongue 14. The tongue 14 pivots with the leaf 46 and the lugs 15 pivot with the leaf 47. The tongue 14 extends beyond the weakened portion 45 toward the leaf 47, and the lugs 15 extend beyond the weakened portion 45 toward the leaf 46. The lugs 15 and the tongue 14 can be formed during stamping of the panel 10 from a blank consisting of cardboard or the like. The material of such blank is severed along the lugs 15 and along the tongue 14 but is only weakened along the portion 45. The outlines of the tongue 14, lugs 15 and weakened portion 45 are indicated in FIG. 1 by a partly dotted and partly dot-dash line, as at 55. The reference character 48 denotes in FIGS. 4 and 5 a wedge-like socket which serves to receive a portion of the apex 43 between the flaps 21*a* and 29 not later than when the leaf 46 is pivoted to the phantom-line position 49 of FIG. 6.

FIGS. 1, 3, 4 and 5 further show an elongated slot-shaped opening 51 which is provided in the leaf 46 of the second section 11 of the panel 10. The purpose of the opening 51 is to enable a clerk to suspend the receptacle on a suitable rod-like support of the type often utilized in cigar stores, department stores, hardware stores and other establishments where the customer is expected or permitted to remove a selected item from the support and to carry or transport it to the checkout counter. The opening 51 is preferably provided midway between the longitudinally extending marginal portions 52 of the panel 10, and the tongue 14 is located between such opening and the chamber 31. Such location of the opening 51 ensures that the suspended receptacle assumes an optimal position for display under the action of gravity. Moreover, such mounting of the receptacle ensures that the sections 21, 22, the flaps 21*a*, 29, the sections 11, 13 and/or the leaves 46, 47 do not exhibit a tendency to pivot relative to each other, i.e., to leave the positions which are shown in FIGS. 1 and 2, namely in which the receptacle occupies a minimal amount of space and all of the notions in its pockets 31, 32 are readily observable through the profiled portions 24, 24*a* of the light-transmitting panel 20.

The weakened portion 16 between the sections 11, 13 of the panel 10 extends all the way between the longitudinally extending marginal portions 52 of this panel, and the two parts of the weakened portion 45 extend from the respective marginal portions 52 to the adjacent lugs 15.

The invention is based on the recognition that the provision of a second flap, or border strip, 29 which preferably extends the full length of the pocket 31 ensures reliable confinement of all needles 30 which remain in their pockets 27 as long as the flap 29 is folded over and behind the needles to assume the position 29' of FIG. 4. Moreover, the thus obtained roof-like structure 40 is more readily engageable by the flap 14 to prevent accidental escape of needles 30 from the chambers 31 and 32.

The second leaf, or border strip, 29 of the second section 21 of the panel 20 does not contribute to the bulk and/or length of the receptacle because the second section of the second panel extends beyond the eyelets 38 of properly inserted needles 30 anyway. This can be readily ascertained by referring to the receptacle which is shown in the aforementioned patent to Hagmann et al. Moreover, the flap 29 is used to releasably connect the section 21 to the section 11 in a fully assembled receptacle while the bonds 28 are still intact.

An important advantage of the flap 29 and of its pivotability to the position 29' is that the needles 30 remain in their respective pockets 27 even if the user fails to engage the tongue 14 with the roof-like structure 40, as long as the flap 29 is at least partially folded over the eyelets 38 of the needles 30. In other words, the presence of a gap between the flap 29 (in or close to the position 29') and the front side of the second section 11 of the panel 10 is of no consequence, i.e., the needles 30 are still compelled to remain in their respective pockets 27.

The drawing shows notions in the form of dressmakers needles 30. However, it is equally within the purview of the invention to use the improved receptacle for the storage and display of other notions, e.g., buttons, safety pins, knitting needles, crochet needles and/or others.

A receptacle or pack for randomly distributed notions is disclosed in commonly owned copending patent application Ser. No. 07/903,711 filed Jun. 24, 1992 by Rudolf von Agris et al. for "Pack for notions and the like".

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A receptacle for storage and display of needles and like notions, comprising:

a. a first panel having a front side and a rear side;

b. a second panel at said front side;

c. said panels having first sections defining a first chamber for first portions of notions and second sections defining a second chamber for second portions of notions adjacent the first chamber, said first sections being substantially permanently affixed to each other around said first chamber; and d. affixing means for separably affixing said second sections to each other at said second chamber, the second section of said second panel being pivotable relative to the second section of said first panel between an initial sealed position adjacent said front side, enclosing the notions, and an open position away from said front side, exposing the notions; and e. said second section of said second panel comprising:

(1) a first flap which overlies the second portions of notions in said initial sealed position, and (2) a border strip, having a front side and a rear side, pivotable relative to said first flap by a hinge from said initial sealed position wherein said border strip lies in a plane with said first flap and said rear side of said border strip engages said front side of said first panel, to a closed position wherein said front side of said border strip is pivoted to engage and lie adjacent said front side of said first panel, said border strip is positioned between said first flap and said first panel, re-enclosing the notions.

2. The receptacle of claim 1, wherein the first section of said second panel has first recesses forming part of said first chamber and the second section of said second panel has a second recess forming part of said second chamber.

3. The receptacle of claim 1, wherein said second panel has a first weakened portion between said sections thereof and a second weakened portion between said first flap and said border strip.

4. The receptacle of claim 1, wherein said second section of said first panel comprises holding means for releasably holding said border strip in said closed position.

5. The receptacle of claim 4, wherein said holding means comprises a tongue forming part of said second section of said first panel and partially overlying said first flap and said pivoted border strip of said second panel in said closed position.

6. The receptacle of claim 1, wherein said first panel has a weakened portion between said sections thereof and the second section of said first panel is pivotable along said weakened portion away from the second portions of the notions and away from the second section of said second panel.

7. The receptacle of claim 6, wherein said second panel has a hinge disposed between the first and second sections thereof and adjacent said weakened portion.

8. The receptacle of claim 7, wherein said second panel has a second hinge between said first flap and said border strip and said second section of said first panel has a second weakened portion at said second hinge, said second section of said first panel comprising a first leaf pivotable relative to said first section of said first panel at said first named weakened portion away from said second portions of the notions and a second leaf pivotable relative to said first leaf, said second leaf having holding means for releasably holding said border strip in said closed position.

9. The receptacle of claim 8, wherein said second hinge extends along said second weakened portion and said holding means comprises a tongue which is pivotable with said second leaf, said second weakened portion having parts at opposite sides of said tongue.

10. The receptacle of claim 9, wherein said first leaf comprises two lugs which are pivotable therewith relative to said second leaf and flank said tongue.

11. The receptacle of claim 1, wherein said second section of said first panel comprises holding means for releasably holding said border strip in said closed position and has at least one opening for facilitating suspension of said first panel on a rod-like support, said holding means being disposed between said at least one opening and said second chamber.

12. The receptacle of claim 1, wherein said affixing means comprises readily destructible bonds between said second sections.

13. The receptacle of claim 12, wherein said bonds are adhesive bonds.

14. The receptacle of claim 1, wherein said affixing means is provided between the second section of said first panel and said border strip.

15. The receptacle of claim 1, wherein said first chamber consists of a plurality of at least partially separated pockets for the first portions of notions.

16. The receptacle of claim 1, wherein the sections of said second panel comprise profiled first portions adjacent said chambers and flat frame-like second portions surrounding said profiled first portions.

17. The receptacle of claim 16, wherein the second section of said second panel comprises a hinge between said first flap and said border strip, said hinge being disposed intermediate the profiled and flat frame-like portions of the second section of said border strip.

18. The receptacle of claim 1, wherein the second section of said second panel has a fold line between said first flap and border strip.

19. A re-closeable receptacle for storing and displaying articles, comprising:

a. a first panel;

b. a second panel;

c. the first panel having first and second sections, said second section pivotally connected to the first section to pivot between an article enclosing position and an article exposing position away from the second panel;

d. the second panel having first and second sections, said second section pivotally connected to the first section to pivot in a direction opposite the second section of the first panel between an article enclosing position and an article exposing position, the second panel being aligned with the first and second sections of the first panel to define first and second chambers, respectively;

e. the second section of the second panel having at an upper edge a border strip which is selectively positionable by a hinge so that:

(3) when the second section is in an initial article enclosing position, the border strip is affixed to the first panel, and (4) when the second section is in a re-closed article enclosing position, the border strip is folded to cover the portion of the articles.

20. The re-closeable receptacle of claim 19, wherein the first panel includes securing means which cooperates with the border strip to secure the border strip in the re-closed position.

21. The re-closable receptacle of claim 20, wherein the securing means includes means for releasably securing the border strip in position when in the re-closed position.

22. The re-closable receptacle of claim 21, wherein the securing means includes a tongue which contacts the border strip.

23. The re-closeable receptacle of claim 19, wherein readily destructible bonds affix the border strip to the first panel in the initial article enclosing position.

* * * * *